US009943752B2

(12) United States Patent
Mackay

(10) Patent No.: US 9,943,752 B2
(45) Date of Patent: Apr. 17, 2018

(54) SUDOKU-BASED PUZZLES

(76) Inventor: Glenn Frederick Mackay, Brighton (GB)

( * ) Notice: Subject to any disclaimer, the term of this patent is extended or adjusted under 35 U.S.C. 154(b) by 328 days.

(21) Appl. No.: 13/297,194

(22) Filed: Nov. 15, 2011

(65) Prior Publication Data

US 2013/0119606 A1 May 16, 2013

(51) Int. Cl.
*A63F 3/00* (2006.01)
*A63F 3/04* (2006.01)

(52) U.S. Cl.
CPC .. *A63F 3/0415* (2013.01); *A63F 2003/00996* (2013.01); *A63F 2003/0418* (2013.01)

(58) Field of Classification Search
CPC ..... A63F 3/0415; A63F 2003/00996; A63F 2003/0418
USPC ..... 273/287, 258, 267
See application file for complete search history.

(56) References Cited

U.S. PATENT DOCUMENTS

2007/0173314 A1* 7/2007 Chen et al. ..... 463/18
2009/0160131 A1* 6/2009 Chen ..... 273/272
2009/0275372 A1* 11/2009 Prucey ..... 463/9
2009/0278310 A1* 11/2009 Bower ..... 273/242
2010/0259001 A1* 10/2010 Muller et al. ..... 273/153 S
2012/0025461 A1* 2/2012 Harris ..... 273/153 R

* cited by examiner

*Primary Examiner* — Vishu Mendiratta
(74) *Attorney, Agent, or Firm* — Adam C. Underwood; Erneste M. Rubi

(57) ABSTRACT

A sudoku-style game for use by a human player includes a game board surface presented to the player which has a plurality of P×Q sub-matrices of cells, each of the cells being divided into a first section and a second section, each section of each cell having sufficient space to contain a visually perceivable indicator, wherein P represents the number of rows in each sub-matrix, and Q represents the number of columns in each sub-matrix, a master matrix having the plurality of P×Q sub-matrices coupled one P×Q sub-matrix to another P×Q sub-matrix to form a desired game board shape, a solution to the game being the completion of the master matrix by the player so that no indicator is repeated more than a respective instructed number of times in each row and column.

16 Claims, 5 Drawing Sheets

SUDOKU-BASED PUZZLES

BACKGROUND OF THE INVENTION

Field of the Invention

The present invention relates to puzzles in general and more particularly to an apparatus and method for providing a puzzle structure in which a surface has a pattern or confining region.

Description of the Related Art

Sudoku is a well-known puzzle-type game. Sudoku typically uses a 9×9 grid of cells divided into nine 3×3 blocks or sub-grids. The object is to fill in the blank cells in a way that each of the numbers 1-9 appear only once in each row, column and block or sub-grid. Some of the cells are already filled in for the player. Typically, there is only one solution to each puzzle. Variations are also known wherein letters or symbols are used rather than numbers. The puzzles have various ratings of difficulty.

Sudoku has become very popular. Many newspapers and magazines include a Sudoku puzzle in the same manner that crossword puzzles have been provided to readers in the past. Like crossword puzzles, compilations of Sudoku games are also provided in books and magazines aimed at the Sudoku player.

BRIEF SUMMARY OF THE INVENTION

Embodiments of the present invention address deficiencies of the art in respect to logic-based puzzles and provide a novel and non-obvious apparatus and computer program product for providing a sudoku-style game. In an embodiment of the invention, a sudoku-style game for use by a human player includes a game board surface presented to the player which has a plurality of P×Q sub-matrices of cells, each of the cells being divided into a first section and a second section, each section of each cell having sufficient space to contain a visually perceivable indicator, wherein P represents the number of rows in each sub-matrix, and Q represents the number of columns in each sub-matrix, a master matrix having the plurality of P×Q sub-matrices coupled one P×Q sub-matrix to another P×Q sub-matrix to form a desired game board shape, a solution to the game being the completion of the master matrix by the player so that no indicator is repeated more than a respective instructed number of times in each row and column of divided cells, a plurality of the sections of the cells having respectively assigned indicators presented to the player at the commencement of the game and where the first sections of each of the cells define a first logic game and the second sections of each of the cells define a second logic game.

In another aspect of the sudoku-style game, the game board shape is a three-dimensional shape. In yet another aspect of the sudoku-style game, the first section and the second section of each cell has a triangular shape. In another aspect of the sudoku-style game, the first section of each cell is non-shaded and the second section of each cell is shaded. In yet another aspect of the sudoku-style game, the indicators for the first logic game are numerals and the indicators for the second logic game are colors Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for an apparatus and computer program product for providing a sudoku-style game. In an embodiment of the invention, a sudoku-style game for use by a human player includes a game board surface presented to the player which has a plurality of P×Q sub-matrices of cells, each of the cells being divided into a first section and a second section, each section of each cell having sufficient space to contain a visually perceivable indicator, wherein P represents the number of rows in each sub-matrix, and Q represents the number of columns in each sub-matrix, a master matrix having the plurality of P×Q sub-matrices coupled one P×Q sub-matrix to another P×Q sub-matrix to form a desired game board shape, a solution to the game being the completion of the master matrix by the player so that no indicator is repeated more than a respective instructed number of times in each row and column, a plurality of the sections of the cells having respectively assigned indicators presented to the player at the commencement of the game and where the first sections of each of the cells define a first logic game and the second sections of each of the cells define a second logic game.

Figure 1:
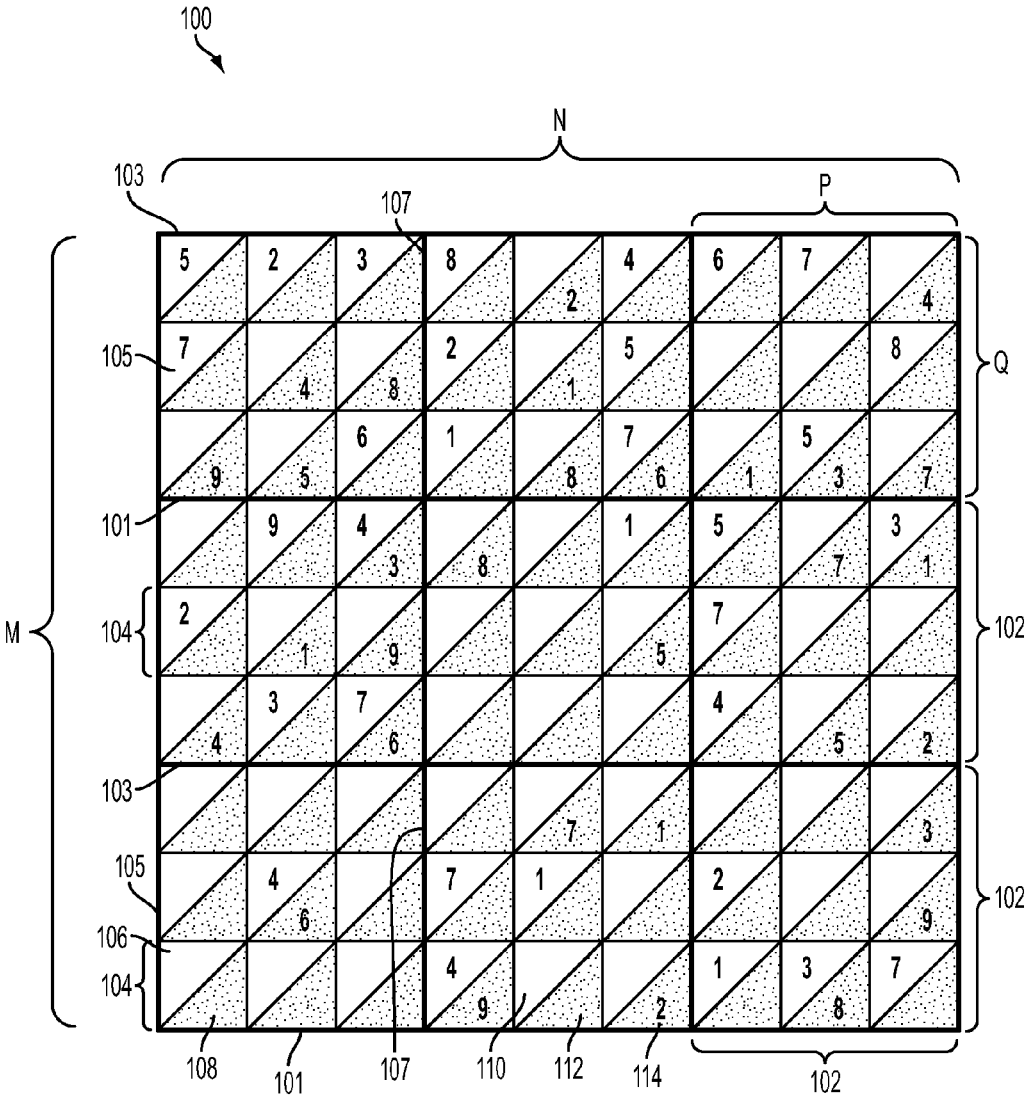
FIG. 1 is an illustration of a game board in accordance with the invention.

Referring initially to FIG. 1, a game board master matrix is illustrated that is constructed in accordance with the present invention. The game board master matrix can be formed on a game board surface, printed in a newspaper or other publication, or generated electronically (such as on a computer or cell phone display). The term "game board" will be used herein, however, to denote the displayed game regardless of whether the display is printed on tangible medium or electronically reproduced (e.g., using an electronic display or a portable electronic device), both of which are within the scope of this invention. As shown in FIG. 1, a game board master matrix 100 is formed by a plurality of P×Q sub-matrices 102, where P represents the number of rows in the sub-matrix 102 and N represents the number of columns in the sub-matrix 102, which are coupled one P×Q sub-matrix to another P×Q sub-matrix to form a desired game board shape. In this embodiment, the game board matrix 100 presented to a player has a game board shape illustrated as an M×N matrix of cells 104, where M represents the number of rows in the master matrix 100 and N represents the number of columns in the master matrix 100. The illustrated game board shape of FIG. 1 is a 9×9 matrix; i.e., the master matrix 100 has nine rows and nine columns of cells 104. The game board matrix 100 has four horizontal and four vertical lines. The sub-matrices 102 have two horizontal lines and two vertical lines within the frame of the horizontal and vertical lines of the game board matrix 100, thus creating nine cells in each of the nine sub-matrices 102. The cells are divided into two portions 106 and 108 and create linear paths that define a first logic game and a second logic. Notably, as illustrated in FIG. 4 and discussed in more detail with reference to FIG. 4, the game board shape is not restricted to a square matrix but can have an irregular shape containing the sub-matrices 102.

Figure 2:
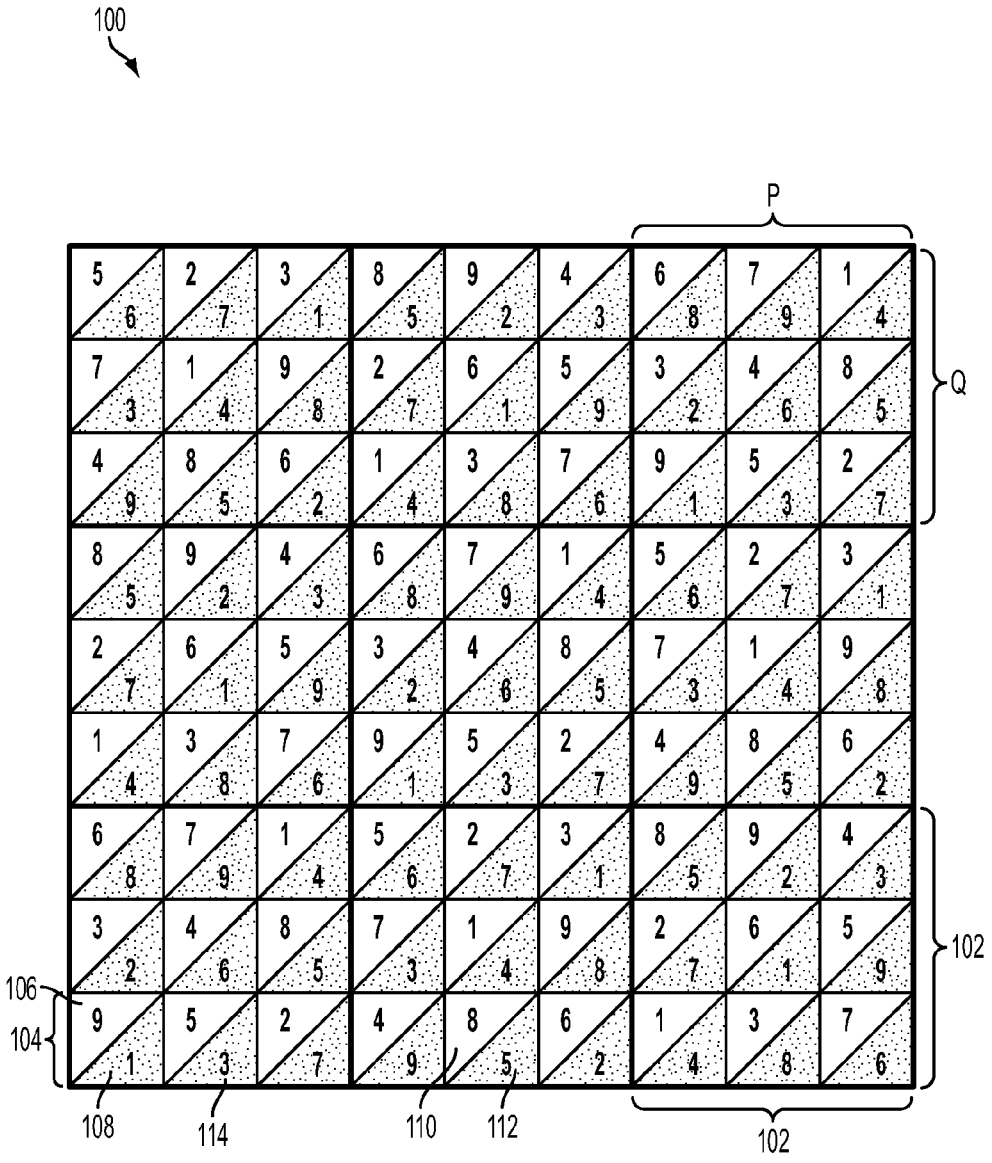
FIG. 2 is an illustration of the game board illustrated in FIG. 1, which shows a solution for that game board.

As illustrated in FIG. 1, each of the sub-matrices 102 are defined by four border lines 101, 103, 105 and 107. In an embodiment, a side border line 107 of a first sub-matrix 102 is coupled to a side border line 105 of a second sub-matrix 102 and a bottom border line 101 of the first sub-matrix 102 is coupled to the top border line 103 of a third sub-matrix 102. In this way, the master matrix game board 100 illustrated in FIG. 1 can be created. Each of the cells 104 are divided into a first section 106 and a second section 108. The division of a cell 104 can be in equal sections or unequal sections. Referring to FIGS. 1 and 2, first section 106 and second section 108 of a cell 104 are both triangles; however, other divisions are available such as squares, rectangles and the like. Continuing to refer to FIGS. 1 and 2, cells 104 can be divided to have a section that is shaded and a section that is non-shaded. For example, as illustrated, first section 106 can be non-shaded, while second section 108 can be shaded. The shading and non-shading defines the direction of play for each logic platform of game play. In other words, the shading and non-shading applied to the first section 106 and second section 108 of the cells 104 provide a path of game play, both in the upward/downward directions as well as the left/right directions. In another embodiment, the shading and non-shading can also indicate a "difficulty rating" for the logic puzzle. For example, shading could indicate a difficulty rating of "HARD" while non-shading could indicate a difficulty rating of "MODERATE".

Figure 3:
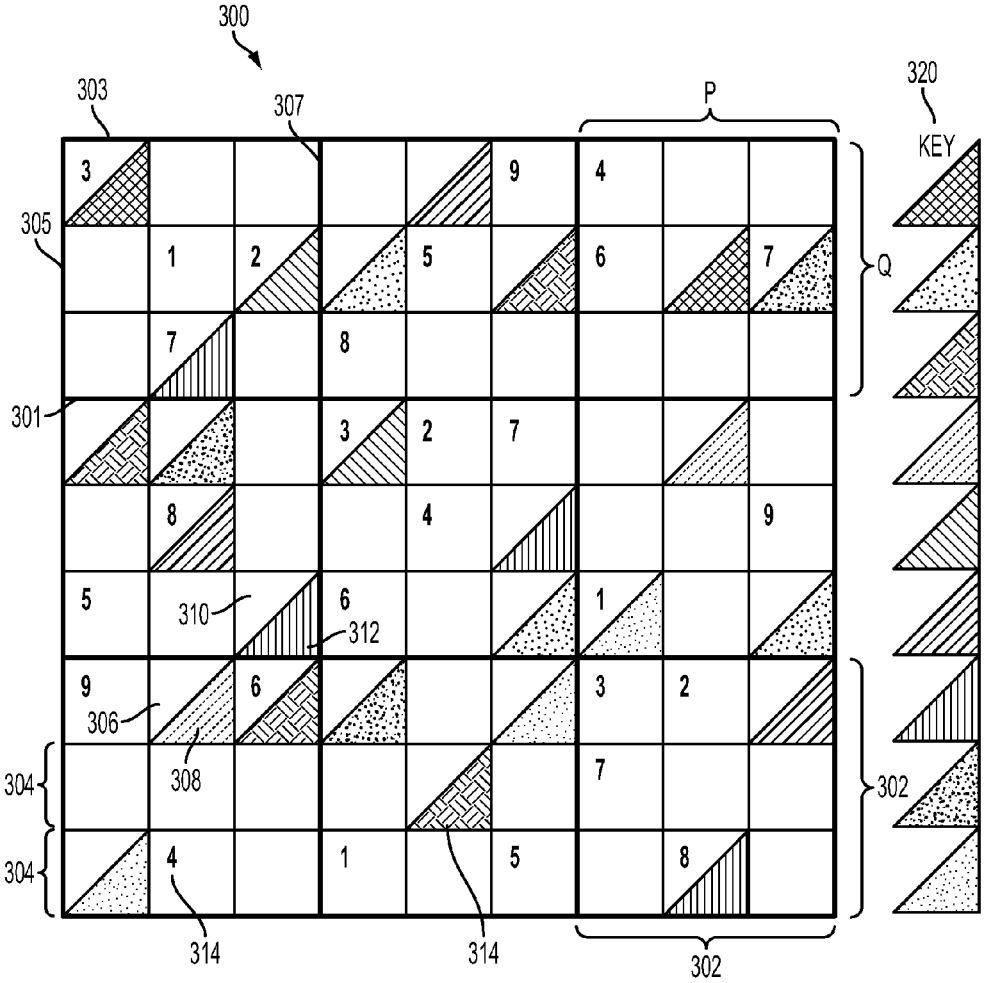
FIG. 3 is an illustration of a second alternative game board in accordance with the invention, where color is used for one of the logic puzzles.

The number of sub-matrices 102 and cells 104 are not restricted to the example of FIG. 1. Additional embodiments can have sixteen sub-matrices 102 each with twelve cells 104, or four sub-matrices 102 each with six cells 104. FIG. 2 is an illustration of the game board illustrated in FIG. 1, which shows a solution for that game board. FIG. 3 is an illustration of a second alternative game board in accordance with the invention, where color is used for one of the logic puzzles. As illustrated in FIG. 3, cells 304 can have a section that includes a color and a section that include an indicator or symbol. For example, first section 306 can include an alphanumeric character, e.g., a number, while second section 308 can be a color. The different colors are illustrated in this black and white line drawing as various cross hatching patterns as indicated by color key 301. It is contemplated that any colors could be used for the designators 314 including but not limited to the primary colors and various shades of those primary colors. For instance, a light red or pink along with a dark red could be used.

Figure 4:
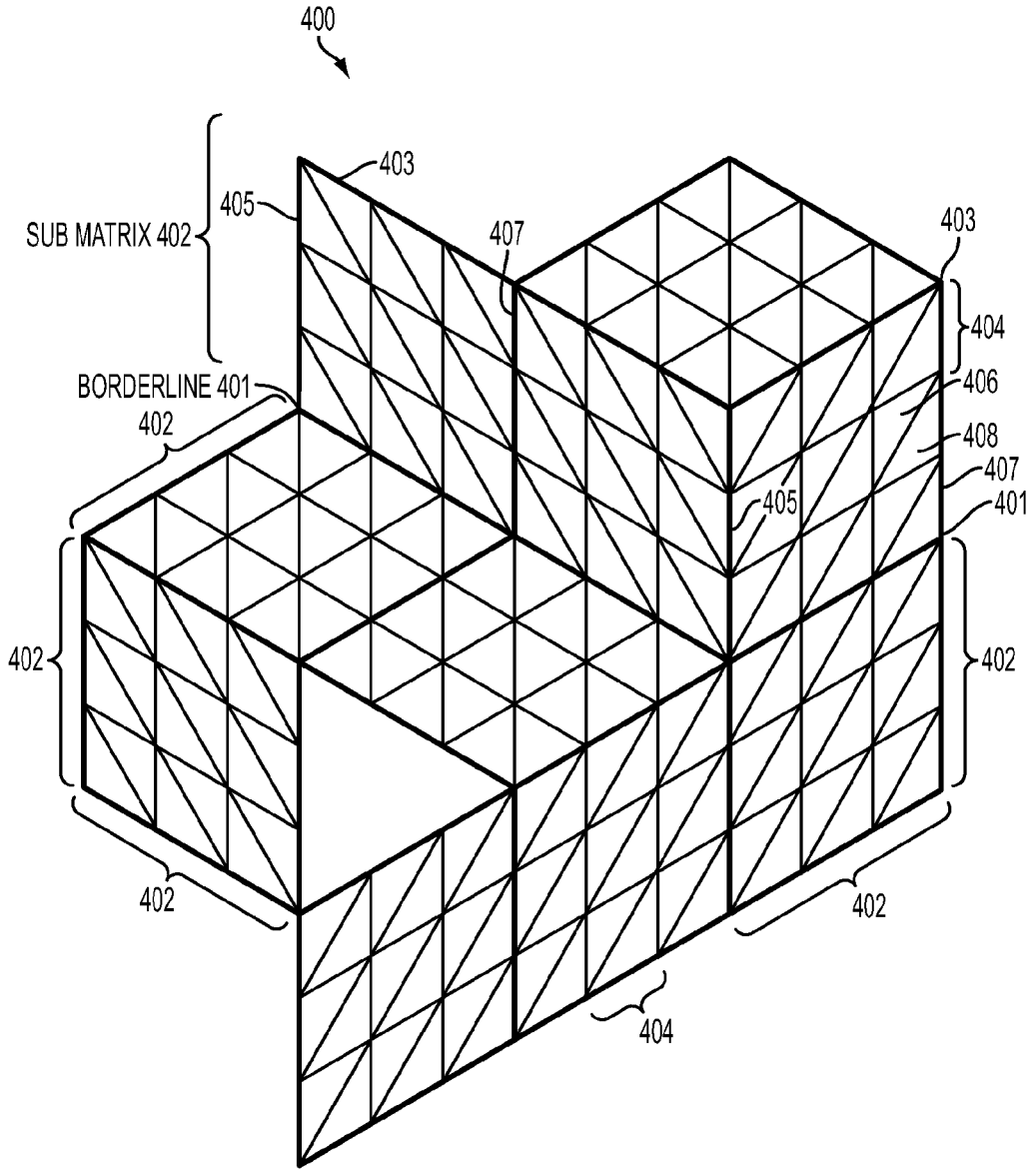
FIG. 4 is an illustration of a third alternative game board in accordance with the invention, which is three-dimensional (3D)

FIG. 4 is an illustration of a third alternative game board in accordance with the invention, which is a three-dimensional (3D) game board shape. A game board master matrix 400 is formed by a plurality of P×Q sub-matrices 402, where P represents the number of rows in the sub-matrix 402 and N represents the number of columns in the sub-matrix 402, which are coupled one P×Q sub-matrix to another P×Q sub-matrix to form a desired game board shape. In this embodiment, the game board matrix 400 presented to a player has a game board shape illustrated as a 3D matrix of cells 404. As illustrated in FIG. 4, each of the sub-matrices 402 are defined by four border lines 401, 403, 405 and 407. In an embodiment, a side border line 407 of a first sub-matrix 402 is coupled to a side border line 405 of a second sub-matrix 402 and a bottom border line 401 of the first sub-matrix 402 is coupled to the top border line 403 of a third sub-matrix 402. In this way, coupling additional border lines 401, 403, 405 and 407 of additional sub-matrices 402 can create the 3D matrix game board illustrated in FIG. 4.

Each of the cells 404 is divided into a first section 406 and a second section 408. Referring to FIG. 4, first section 406 and second section 408 are triangles; however, other divisions are available such as squares, rectangles and the like. Continuing to refer to FIG. 4, cells 404 can have a section that is shaded and a section that is non-shaded. For example, as illustrated, first section 406 can be non-shaded, while second section 408 can be shaded.

Figure 5:
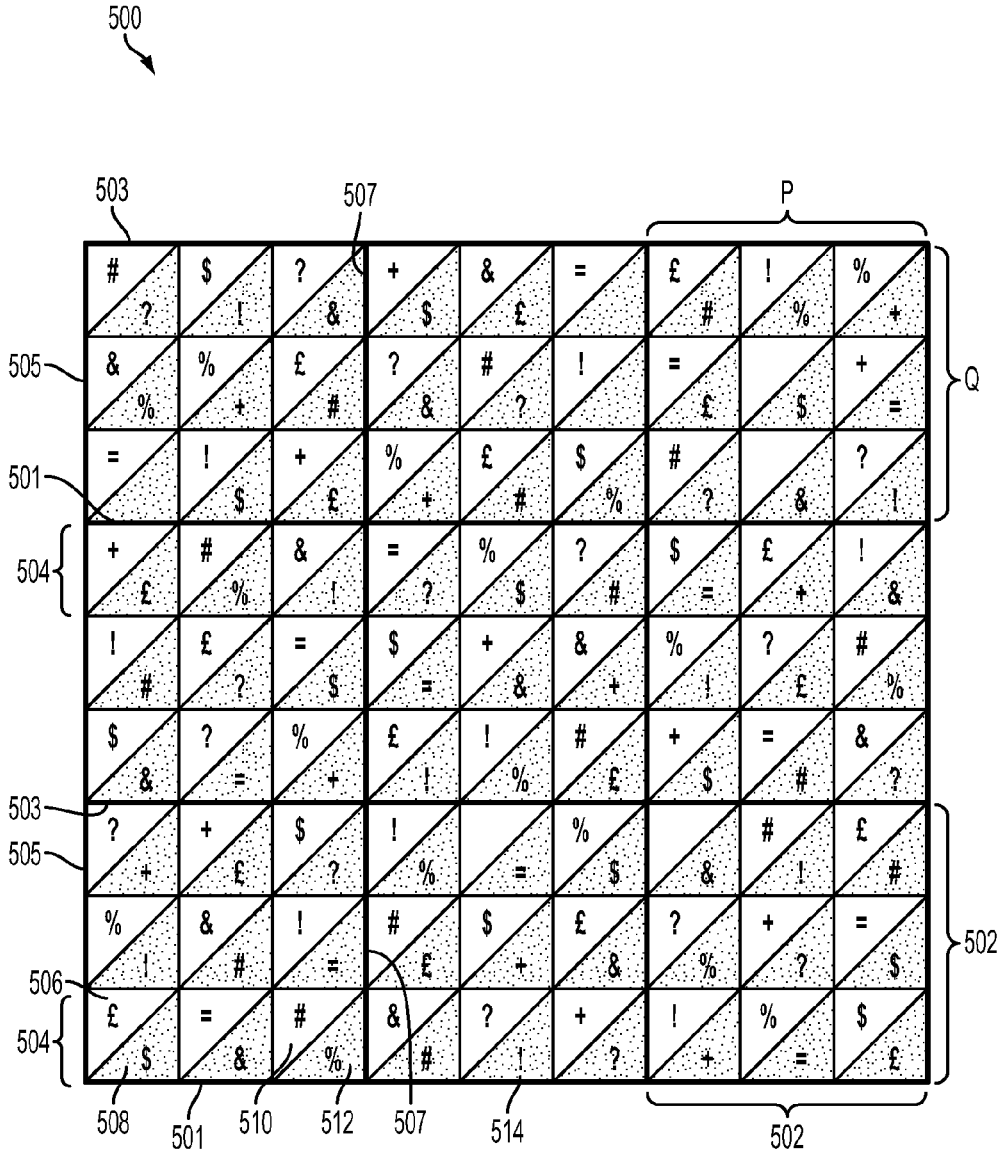
FIG. 5 is an illustration of a fourth alternative game board in accordance with the invention, where icons or symbols are used for the logic puzzles.

FIG. 5 is an illustration of a fourth alternative game board in accordance with the invention, where icons are used for the logic puzzles. Similar to FIG. 1, as shown in FIG. 5, a game board master matrix 500 is formed by a plurality of P×Q sub-matrices 502, where P represents the number of rows in the sub-matrix 502 and N represents the number of columns in the sub-matrix 502, which are coupled one P×Q sub-matrix to another P×Q sub-matrix to form a desired game board shape. In this embodiment, the game board matrix 500 presented to a player has a game board shape illustrated as an M×N matrix of cells 504, where M represents the number of rows in the master matrix 100 and N represents the number of columns in the master matrix 500. The illustrated game board shape of FIG. 5 is a 9×9 matrix; i.e., the master matrix 500 has nine rows and nine columns of cells 504. As illustrated in FIG. 5, each of the sub-matrices 502 are defined by four border lines 501, 503, 505 and 507. In an embodiment, a side border line 507 of a first sub-matrix 502 is coupled to a side border line 505 of a second sub-matrix 502 and a bottom border line 501 of the first sub-matrix 502 is coupled to the top border line 503 of a third sub-matrix 502. In this way, the master matrix game board 500 illustrated in FIG. 5 can be created. Each of the cells 504 are divided into a first section 106 and a second section 508. The division of a cell 504 can be in equal sections or unequal sections. As illustrated in FIG. 5, various icons or symbols can be used such as $, #, !, ?, %, +, =, &, £ and the like.

In operation, the following rules apply to the sudoku-based games described herein. Each symbol, e.g., number 1-9 should appear only once without duplication in each row and each column of the non-shaded sections, e.g., triangles. Each symbol, e.g., number 1-9 should appear only once without duplication in each row and each column of the non-shaded sections, e.g., triangles. The same symbol, e.g., number, must not appear within the same cell containing a shaded and non-shaded section, e.g., triangle. In an alternative embodiment, a matrix that uses colors for the first and second sections of a cell can be provided. In this embodiment, a puzzle can be developed for early learning, learning difficulty and dyslexia training In this embodiment, unlike the previous logic puzzles, the same indicator is to be placed within both sections of a divided cell.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, radiofrequency, and the like, or any suitable combination of the foregoing. Computer program code for carrying out operations for aspects of the present invention may be written in any combination of one or more programming languages, including an object oriented programming language and conventional procedural programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention have been described above with reference to flowchart illustrations and/or block diagrams of methods, apparatus (systems) and computer program products according to embodiments of the invention. In this regard, the flowchart and block diagrams in the Figures illustrate the architecture, functionality, and operation of possible implementations of systems, methods and computer program products according to various embodiments of the present invention. For instance, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It also will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A computer implemented method for providing a sudoku-style game, the method comprising:

generating, in memory of a computer, a game board surface image having a plurality of P×Q sub-matrices of cells, wherein P represents the number of rows in each sub-matrix, and Q represents the number of columns in each sub-matrix;

dividing, in the memory of the computer, each of the cells of each of the plurality of P×Q sub-matrices into a first section and a second section, each section of each cell having sufficient space to contain a visually perceivable indicator, the first sections of each of the divided cells defining a first logic game and the second sections of each of the divided cells defining a second logic game, the first logic game and the second logic game combine to define an overall master matrix logic game;

assigning, at the commencement of the game, a plurality of indicators to a respective plurality of the sections of the divided cells;

generating a master matrix having the plurality of P×Q sub-matrices coupled one P×Q sub-matrix to another P×Q sub-matrix to form a desired game board shape;

completing the master matrix logic game so that each indicator is displayed only once in each row of the divided cells and in each column of the divided cells; and rendering the master matrix on an electronic display.

2. The method of claim 1, wherein the game board shape is a square matrix.

3. The method of claim 1, further comprising:

generating a three-dimensional game board shape, wherein a side border line of a first sub-matrix is coupled to a side border line of a second sub-matrix and a bottom border line of the first sub-matrix is coupled to a top border line of a third sub-matrix; wherein the first sub-matrix and the third sub-matrix are perpendicular to each other.

4. The method of claim 1, wherein the first section and the second section of each cell has a triangular shape.

5. The method of claim 1, wherein the first section of each cell is non-shaded and the second section of each cell are shaded.

6. The method of claim 1, wherein the indicators are numerals.

7. The method of claim 1, wherein the indicators for the first sections of the first logic game are numerals and the indicators for the second sections of the second logic game are colors.

8. The method of claim 1, wherein the indicators for the first sections of the first logic game are icons and the indicators for the second sections of the second logic game are colors.

9. The method of claim 1, wherein the indicator is presented two times in each row and column of the master matrix, one time for the first logic game and one time for the second logic game.

10. The method of claim 1, wherein the same indicator is not repeated in the first section and the second section of the same cell.

11. The method of claim 1, wherein the same indicator is repeated in the first section and the second section of the same cell.

12. The method of claim 1, wherein the game board shape is displayed using a portable electronic device.

13. The method of claim 1, further comprising:

displaying the master matrix on printed media.

14. A computer program product residing on a computer readable storage medium for providing a sudoku-style game, the computer program product comprising instructions for causing a computer to:

generate , in memory of a computer, a game board surface image having a plurality of P×Q sub-matrices of cells, wherein P represents the number of rows in each sub-matrix, and Q represents the number of columns in each sub-matrix;

divide, in the memory of the computer, each of the cells of each of the plurality of P×Q sub-matrices into a first section and a second section, each section of each cell having sufficient space to contain a visually perceivable indicator, the first sections of each of the divided cells defining a first logic game and the second sections of each of the divided cells defining a second logic game, the first logic game and the second logic game combine to define an overall master matrix logic game;

assign, at the commencement of the game, a plurality of indicators to a respective plurality of the sections of the divided cells;

generate a master matrix having the plurality of P×Q sub-matrices coupled one P ×Q sub-matrix to another P×Q sub-matrix to form a desired game board shape;

complete the master matrix logic game so that each indicator is displayed only once in each row of the divided cells and in each column of the divided cells; and render the master matrix on an electronic display.

15. An apparatus comprising:

a processor; and a computer program product embodied on a computer readable storage medium, the computer program product comprising instructions for causing the processor to:

generate a game board surface image having a plurality of P×Q sub-matrices of cells, wherein P represents the number of rows in each sub-matrix, and Q represents the number of columns in each sub-matrix;

divide each of the cells of each of the plurality of P×Q sub-matrices into a first section and a second section, each section of each cell having sufficient space to contain a visually perceivable indicator, the first sections of each of the divided cells defining a first logic game and the second sections of each of the divided cells defining a second logic game, the first logic game and the second logic game combine to define an overall master matrix logic game;

assign, at the commencement of the game, a plurality of indicators to a respective plurality of the sections of the divided cells;

generate a master matrix having the plurality of P×Q sub-matrices coupled one P ×Q sub-matrix to another P×Q sub-matrix to form a desired game board shape;

complete the master matrix logic game so that each indicator is displayed only once in each row of the divided cells and in each column of the divided cells; and render the master matrix on an electronic display.

16. A sudoku-style game comprising:

a game board surface image having a plurality of P×Q sub-matrices of cells, each of the cells being divided into first section and a second section, each section of each cell having sufficient space to contain a visually perceivable indicator, wherein P represents the number of rows in each sub-matrix, and Q represents the number of columns in each sub-matrix, the first sections of each of the divided cells defining a first logic game and the second sections of each of the divided cells defining a second logic game;

a master matrix having the plurality of P×Q sub-matrices coupled one P×Q sub-matrix to another P×Q sub-matrix to form a desired game board shape, wherein a solution to the game being the completion of the master matrix by a player so that no indicator is repeated more than a respective instructed number of times in each row and column of divided cells, a plurality of the sections of the cells having respectively assigned indicators presented to the player at the commencement of the game; and wherein the first logic game and the second logic game combine to define a overall master matrix logic game; and wherein the master matrix is displayed on printed media.

* * * * *